US005131790A

United States Patent [19]

Simpson

[11] Patent Number: 5,131,790

[45] Date of Patent: Jul. 21, 1992

[54] METHOD AND APPARATUS FOR INSTALLATION OF AN OUTER-CASED PILING

[75] Inventor: Elizabeth E. Simpson, Plaquemine, La.

[73] Assignee: The Dow Chemical Company, Midland, Mich.

[21] Appl. No.: 726,491

[22] Filed: Jul. 8, 1991

[51] Int. Cl.[5] ..... E02D 5/34

[52] U.S. Cl. ..... 405/236; 405/229; 405/233

[58] Field of Search ..... 405/233, 236-243, 405/229, 232

[56] References Cited

U.S. PATENT DOCUMENTS

| | | | |
|---|---|---|---|
| 940,100 | 11/1909 | Welsh | 405/242 |
| 1,751,607 | 3/1930 | Smith | 405/239 X |
| 1,907,654 | 5/1933 | Newman | 405/240 X |
| 3,206,935 | 9/1965 | Phares | 405/242 |
| 3,736,757 | 6/1973 | Hartzell et al. | 405/242 |
| 3,886,754 | 6/1975 | Turzillo | 405/241 X |
| 4,152,089 | 5/1979 | Stannard | 405/242 |

*Primary Examiner*—Dennis L. Taylor

[57] ABSTRACT

The invention is a method of installing an outer-cased piling through a zone of subsoil contamination, and the apparatus used therein, which includes boring a hole to a predetermined depth below the contamination, placing a smaller diameter casing in the full length of the hole, pumping a cementitious material between the outer casing wall and the soil, installing the piling through the casing and down to a support layer well below the contaminated zone, filling the piling form with cement and then filling the void between the piling and casing with a cementitious material.

The outer-cased piling design allows the piling installation through zones of contamination without adversely impacting the environment or spreading the contamination to other subsurface layers.

19 Claims, 4 Drawing Sheets

METHOD AND APPARATUS FOR INSTALLATION OF AN OUTER-CASED PILING

BACKGROUND OF THE INVENTION

This invention relates to a method of installing a structural support piling in a subsoil setting passing through a zone of contamination, and the apparatus used therein. This piling, or group of pilings, can be used to support an at or above ground structure without adversely affecting or impacting the environment.

One conventional method of achieving support for a structure over non-contaminated ground would include the installation of a concrete spread footing of sufficient dimensions and strength, in the cured state, to support the structure at or above ground level. Another conventional method would include pile driving a metal or wood piling down to a dense underground layer structure. In the situation where below ground contamination has been determined to exist, usually by soil analyses of materials taken from different depths into the subsoil, and particularly where an aquifer could be involved, a concrete spread footing could settle and preclude or interfere with the excavation or other type of penetration of a contaminated zone below the footing at a future date. Settling of a concrete spread footing could also cause tilting problems for structures that have to be rigidly held in place. The conventional pile driving method is not advisable because of the possibility of forcing contaminants toward an aquifer.

SUMMARY OF THE INVENTION

The invention contemplates a method of installing an outer-cased piling, in an earth formation, to support a structure at or above ground level over a zone or zones of underground contamination, particularly where an aquifer is situated at some level below the contamination, without adversely impacting the environment or promoting contamination migration; and the resulting outer-cased piling. This method overcomes the potential problem of forcing or displacing contaminants towards an aquifer as may occur in either installing a concrete spread footing or in driving a pile utilizing conventional techniques. This method also overcomes the potential problem of the structure tilting caused by settling of a concrete spread footing.

In this invention the underground formation, whether soil or rock or a combination, is sampled to determine the location and types of any contamination using conventional coring techniques. Geological measurements are also taken to locate the depth of any water tables in the zone. A borehole or shaft is then sunk to a level such that the bottom of the borehole is below the level of contamination, and in proximal contact to the first relatively impervious clay layer below the zone of contamination. A metal casing is then installed in the borehole and the annular space formed between the outer casing and the wall of the borehole is filled by pumping a cementitious material down the inside of the casing and then upwardly through the annular space. Without this outer casing and the cementitious seal, seepage of contaminants into the borehole, from the contaminated zone, would occur with a layer of contamination collecting at the lowest end of the borehole. This contamination might then, undesirably, be forced downward through a dense underground layer or migrate to water levels during a subsequent pile driving step.

In accordance with the invention, a piling, typically made from sturdy wood, metal, or metal pipe, is placed inside the cemented-in casing and driven down towards but stopping short of the dense layer above any drinking water aquifer without perforating the dense layer. The piling is then cemented in place within the casing. In the case where the piling is a metal pipe, it is filled with a concrete mixture designed to have a high breaking strength in the cured state. Preferably anchors or hairpins or other attachment means are affixed to the top of the pile form and encased in a concrete pad to assist in anchoring the structure to be cast or otherwise placed on the piling.

DESCRIPTION OF THE PREFERRED EMBODIMENTS

Figure 1:
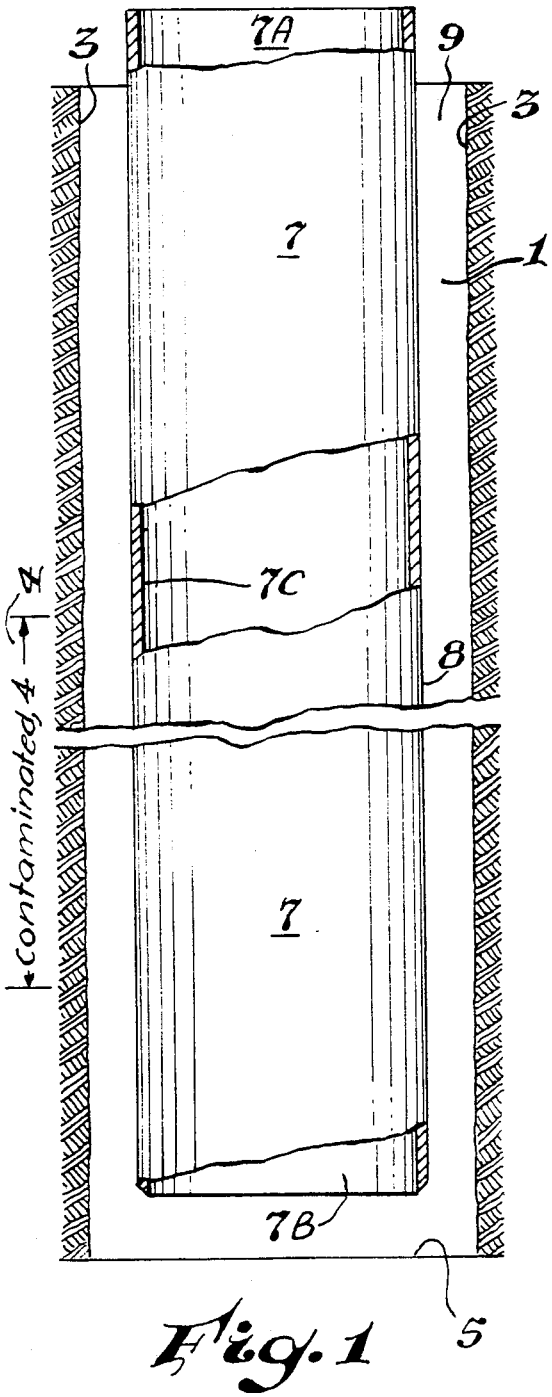
FIG. 1 is a vertical sectional view, mostly schematic, which illustrates a metal casing placed in an excavated cavity.

As indicated above, this invention relates to a method for installing an outer-cased structural support piling in a subsoil setting passing through a zone of contamination and the apparatus resulting from operation of the method. The following description illustrates the manner in which the principles of the present invention are applied, but the invention is not to be construed, in any sense, as limiting the scope of the invention precisely to the structure shown in the drawings.

In the case where it is desired to build a structure at or above ground level, it is common practice to conduct geologic and hydrogeologic tests of the ground in the vicinity of the proposed construction. This typically entails core boring, analysis of soil removed for contaminants, such as organic chemicals, chlorides and heavy metals, location of water tables, and types of soil or rock layers such as previous and impervious layers. These data, along with other considerations, such as the weight of the structure to be supported, are used in determining the type of support system for the application according to calculations or estimates well understood in the art. These types of support systems can range from a concrete spread footing to a friction pile to a deep pile with pilings driven downward to an identified dense layer. After the analyses of the geologic area are completed, if contamination is determined to be present, then decisions are made with regard to the environment and the structure as to the best method for supporting the proposed structure.

Figure 2:
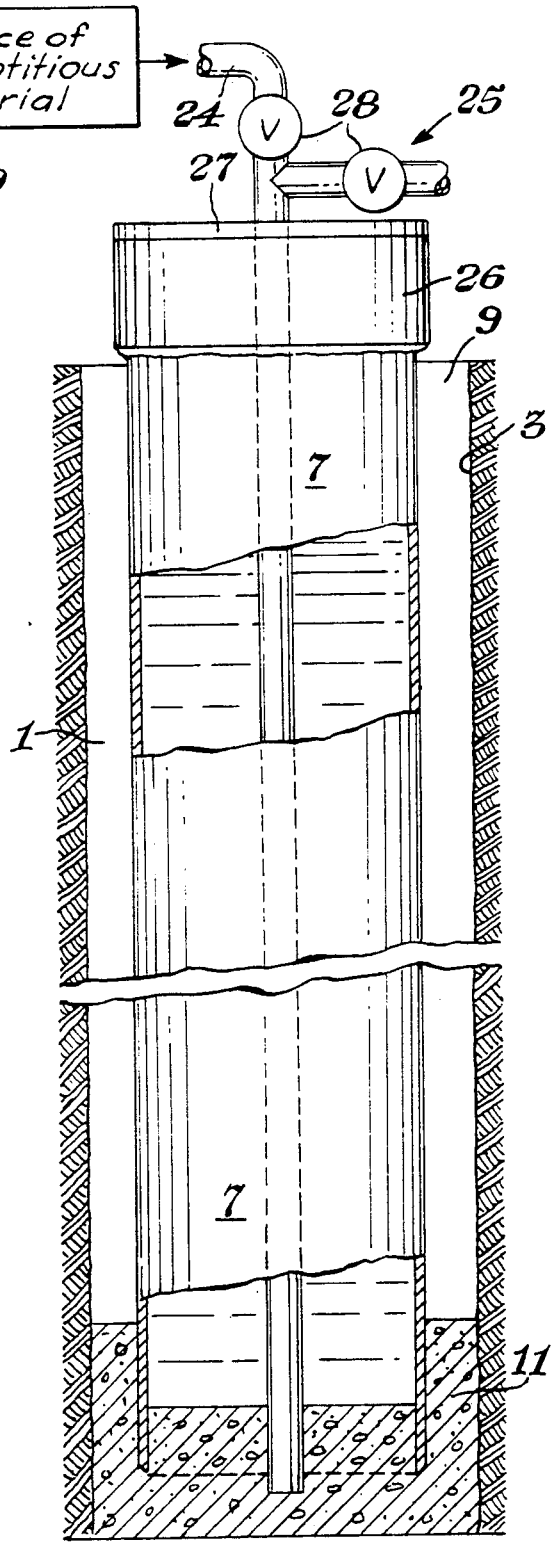
FIG. 2 is a view in vertical section, mostly schematic, which illustrates the cementitious material as a hydraulic seal, the water-filled casing during the cementing step, and the cap, and the tube used during cementing.
Figure 6:
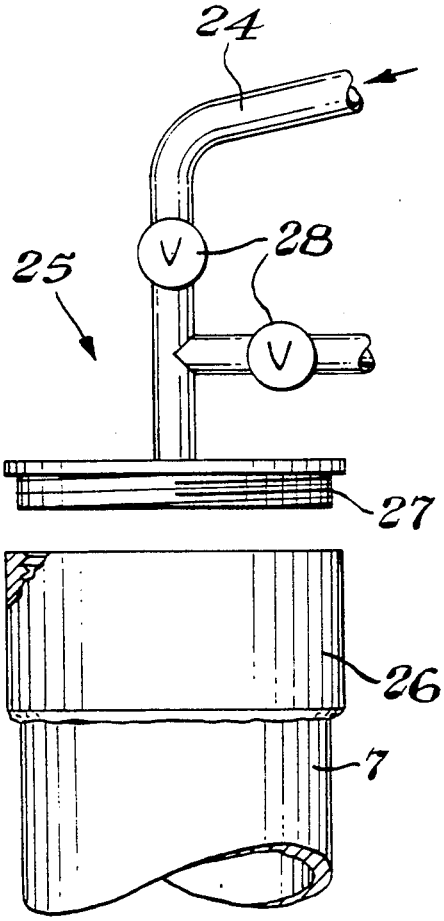
FIG. 6 is a schematic of the pile top cap in elevation along with the valving used during cementing-in of the casing.

Referring to the drawings, particularly FIG. 1, in the case of the instant invention using an outer-cased piling to support an at or above ground structure in an area of subsoil contamination, a borehole or shaft is excavated to a depth below the zone of contamination 4 and preferably in proximal contact to form a substantially cylindrical cavity 1 surrounded by a substantially cylindrical wall 3 of soil or rock and a closed bottom 5. A cylindrical metal casing 7, having open upper end 7A and open lower end 7B, an inside surface 7C and an outside surface 8, with the upper end 7A being capable of being sealed by an attachable cap assembly 25, seen in fragmentary enlarged view in FIG. 6, is then placed in the borehole 1 and past the contaminated zone 4. The diameter of the metal casing 7 is smaller than that of the borehole 1 so as to leave an annular space 9 between the casing 7 and the borehole wall 3. The cap assembly 25, as more particularly shown in FIG. 6, is attached to the upper end 7A of the casing 7 as shown in FIG. 2 and a length of tubing 24, having a block and bleed valve assembly 28, is connected to a source 29 of pumpable cementitious material 11, and is inserted through the cap assembly 25. The cap assembly 25 is conveniently assembled by welding or otherwise affixing, preferably with a threaded coupling 26 onto the casing 7 and attaching a threaded cap 27 containing an aperture for sealing passage therethrough of a length of tubing 24. The tubing 24 has connected thereto adjacent to cap 27 a block and bleed valve assembly 28 to facilitate the pumping of cementitious material. After putting together the casing cap assembly 25, an amount of pumpable cementitious material 11 is pumped into the bottom of the borehole 1 to a depth sufficient to form an hydraulic seal at the lower end 7B of the casing 7.

Figure 3:
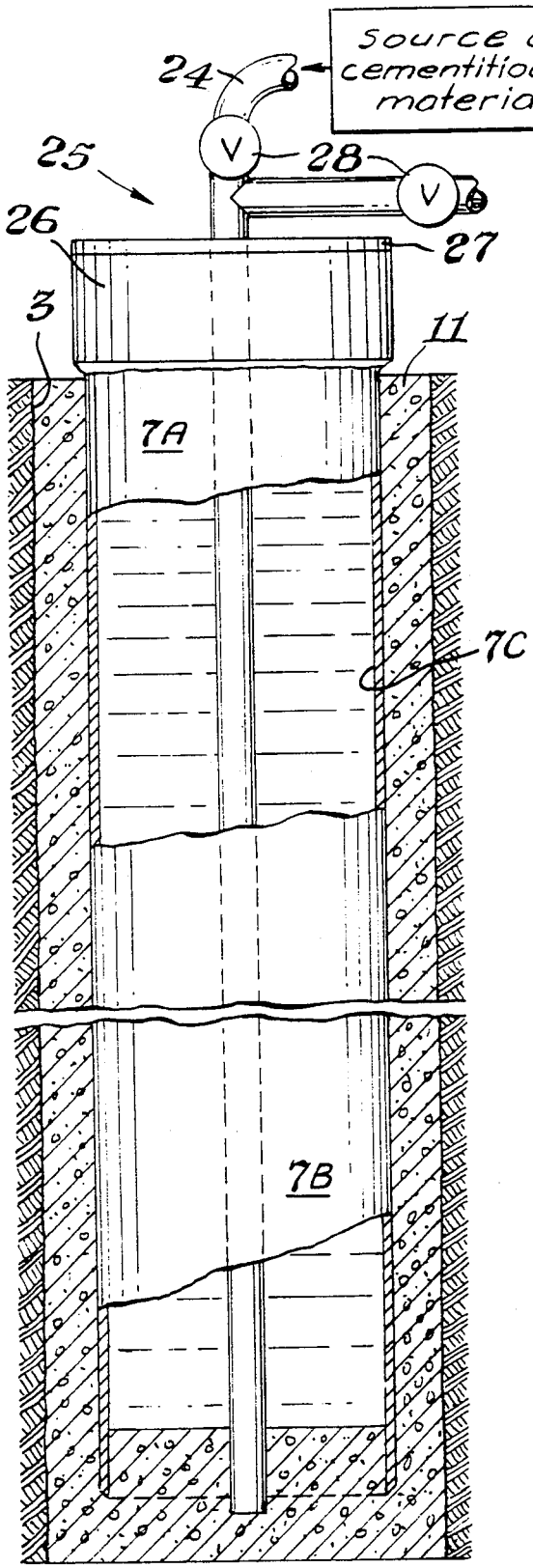
FIG. 3 is a view in vertical section. mostly in schematic, which illustrates the annular space between a borehole in an existing earth formation and a metal casing filled with pressure grout as cementitious material.
Figure 4:
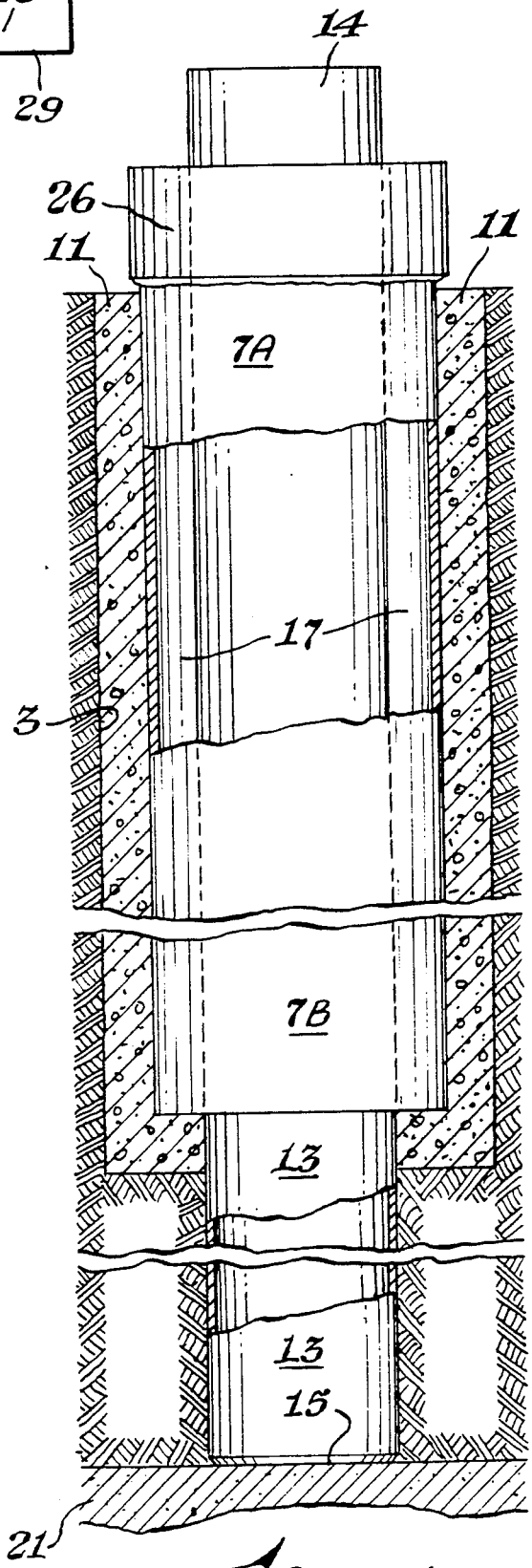
FIG. 4 is a view in vertical section, mostly in schematic, which illustrates a metal pile form extending through the casing to a dense sand layer.

Referring to FIG. 2, while the cementitious material 11 such as a slurry mixture of cement and clay, is still fluid at the bottom of the hole 1, water is added to fill the casing 7 from the topmost portion of the hydraulic seal to at least a level in the upper end 7A of the casing 7. Additional cementitious material 11 is then pumped into the casing 7 through the cap assembly 25 while the assembly is attached resulting in forcing cementitious material up the annular space 9 with water filling the casing and the tubing 24 extending to the hydraulic seal and this is continued until cementitious material exits the top of the annular space 9 formed by the borehole wall 3 and the outside surface 8 of the casing 7. The sealed annular space 9 is shown in FIGS. 3 and 4 filled with cementitious material 11. Any contamination that may have seeped into the borehole 1 during the drilling or the casing installation steps is forced out through the annular space 9 at this time.

Figure 5:
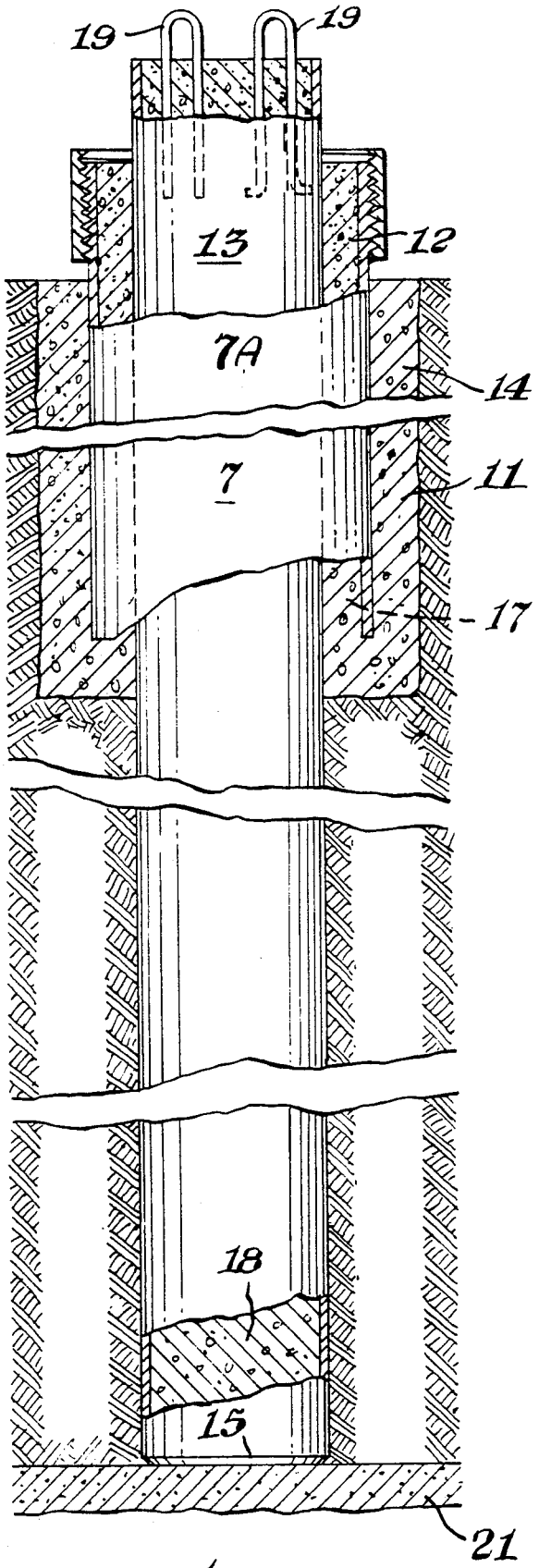
FIG. 5 is a view in vertical section, mostly schematic, to illustrate the cementitious material between the inside of the metal casing and the outside of the metal pile form. This schematic also shows the location of anchors and the pile form.

After allowing the cementitious material 11 to cure to a hardened state to support the casing 7 in a generally upright position, the cap 27 of the cap assembly 25 is removed and a substantially cylindrical metal pile form 13, with a diameter smaller than that of the metal casing 7, and having a closed bottom end or pile base cap 15, as shown in FIGS. 4 and 5, is inserted into the casing 7 and driven beyond the bore of the lower end 7B of the casing 7 in substantial axial alignment with the longitudinal axis of the casing 7. As shown in FIG. 4, the metal pile form 13 is driven to a depth in the subsoil sufficient to provide support for a structure at or above ground level without extending into any aquifer and forming a second or inner annular space 17 as shown in FIG. 5, between the outer wall of the metal pile form 13 and the inner wall 7C of the casing 7. The metal pile form 13 is then filled with a pumpable structurally supporting cementitious material 18 having a cured breaking strength of at least 1000 psi. The pile bottom closure 15 in this embodiment serves a dual purpose. In the first instance it prevents soil or other drilling debris from entering the inside of the metal pile form 13 while it is being driven and in the second instance it prevents the concrete mixture being poured into the metal pile form 13 from escaping at the base of the metal pile form 13.

Figure 7:
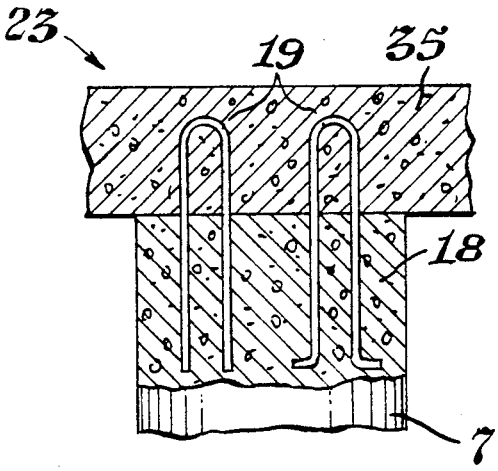
FIG. 7 is a fragmentary view in section of anchor loops at the top of the pile form as used to anchor a structure in the form of concrete a slab cast across the top of the pile form and enveloping the, partly broken away and mainly schematic, hairpins protruding therefrom.

Referring to FIG. 5, the second annular space 17 between the metal pile form 13 and the inside surface 7C of the casing 7 is then filled with a pumpable cementitious material 12, which can be the same as or different from the pumpable cementitious material 11 in annular space 9, and is allowed to cure to a hardened state. In order to anchor the structure to the support apparatus 23 as in FIG. 7 one or more anchor loops 19 can be installed in the uncured cementitious material at the top of the support apparatus 23. The one or more anchor loops 19 can then be encased in a concrete cap 35 as shown in FIG. 7.

The metal pile form 13 used in this invention is a metal pipe and preferably is a carbon steel pipe. The cementitious material 18 used to fill the pile form in this invention is preferably concrete and more preferably concrete with a minimum breaking strength of at least 1000 psi after curing for 28 days. To achieve this value typically requires a 5½ bag mix. Another aspect of this invention relates to the cementitious materials, 11 and 12 respectively, used to fill the annular spaces between a) the borehole wall 3 and the outside surface 8 of the casing 7, and b) the inside wall 7C of the casing 7 and the outside of the metal pile form 13. Preferably, this cementitious material is grout and more preferably is pressure grout.

Figure 8:
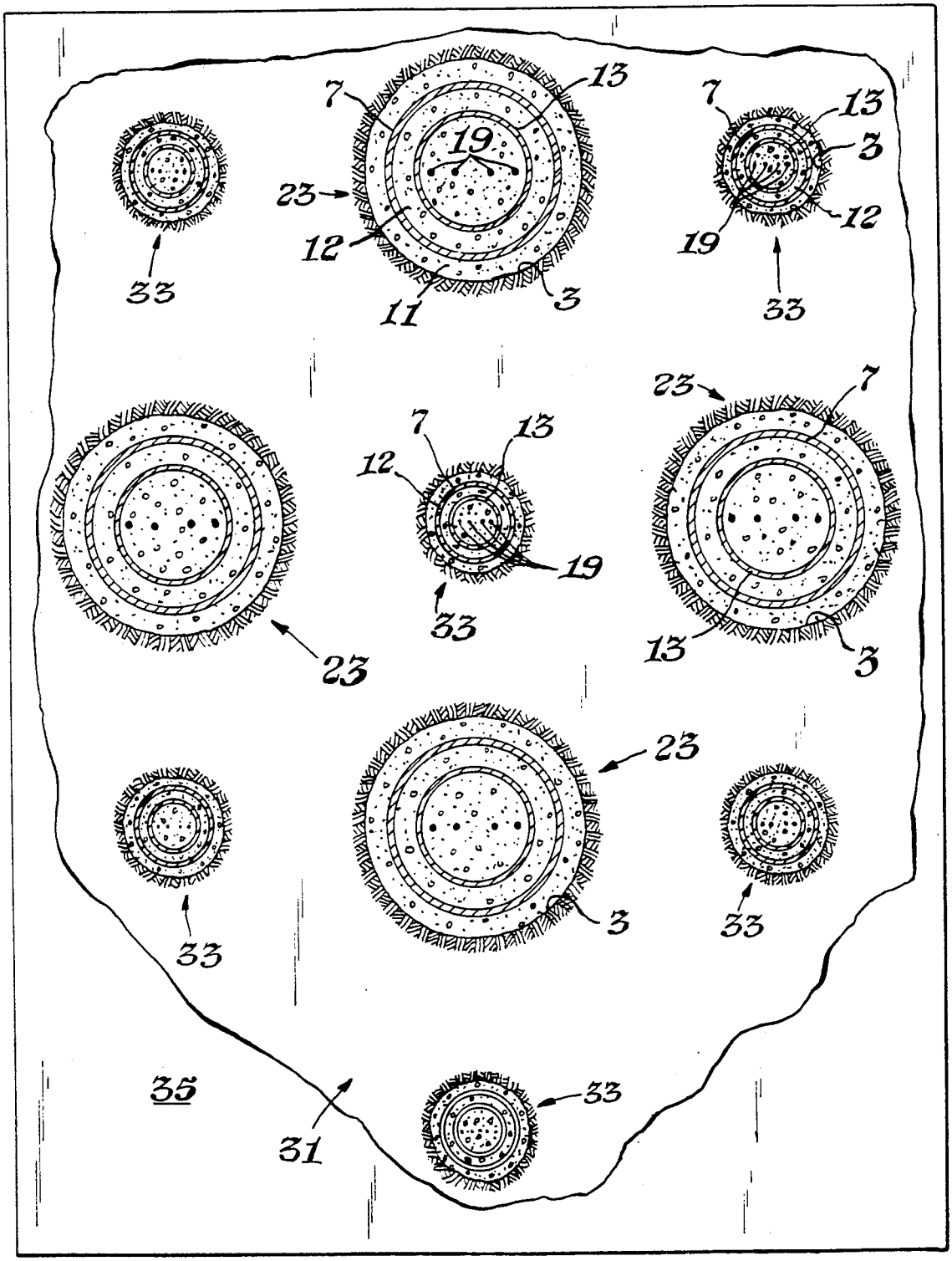
FIG. 8 is a top view of an array of apparatuses supporting a structure in the form of a slab of concrete on which apparatus or further structure may be supported.

Referring now to FIGS. 5 and 8, another embodiment of this invention takes the form of an apparatus, preferably a support apparatus 23, for a structure to be supported at or above ground level on or over an earth formation having underground environmental contaminants in a zone at a predetermined depth. This support apparatus 23 includes a metal casing 7 having an upper end, a lower end, and inner and outer surfaces. The metal casing 7 is of sufficient length to have its upper end at or above ground level and its lower end below the predetermined lowest level of contamination and ending adjacent to the first relatively impervious clay layer below the zone of contamination. The casing has an outer substantially cylindrical wall 8 and is installed in an excavated cavity 1 in the ground in a generally upright position. Installed between the casing 7 and the borehole wall 3 is a hardened cementitious material 11 that is in intimate contact with both. A hollow metal pile form 13, having an upper end and a lower end and an upper portion and a lower portion and a bottom pile base cap or closure 15, is substantially housed within the casing 7 and extends downwardly beyond the casing to an underground dense layer stratum 21 without perforation of the dense layer or any aquifer in the earth formation. The upper end 14 of the metal pile form 13 extends to approxiately the same level as the upper end 7A of the casing 7. The metal pile form 13 fully contains a cured structurally supporting cementitious material 18, having a cured breaking strength of at least 1000 psi. The second annular space 17 between the outside surface of the metal pile form 13 and the inside surface 7C of the casing 7 fully contains a hardened cementitious material 12.

As a further aspect of the support apparatus 23 of this invention the metal pile form 13 used in the apparatus is ordinarily a metal pipe and preferably is a carbon steel pipe. Also, the cured concrete material used to fill the pile form has preferably a minimum breaking strength of 1000 psi. As another aspect of the invention the cementitious materials 11 and 12 are grout and are preferably pressure grout. The apparatus of the invention having at least one anchor loop 19 at the top of the support apparatus 23 to anchor the supported structure is yet another embodiment of the invention. Depending on the size and weight of the supported structure the apparatus of the invention further contemplates an array 31 of support apparatuses 23, such as the array in FIG. 8, where an array preferably constitutes at least four support apparatuses 23 and more preferably at least ten such apparatuses including support apparatuses 33 supporting a large heavy structure such as concrete slab 35 mostly broken away here to show the underlying structural support apparatuses.

What is claimed is:

1. A method for installing a structural support piling in a subsoil setting passing through a zone of contamination comprising:

a. creating a borehole through said contaminated ground to a depth below the zone of contamination and ending adjacent thereto forming a substantially cylindrical cavity surrounded by substantially cylindrical walls and a closed bottom, b. placing in the so formed borehole and extending past the contaminated zone a cylindrical metal casing having an upper and a lower end and an inside surface, the upper end being capable of being closed by an attachable cap, the lower end being open;

c. closing the upper end of the metal casing by attaching an attachable cap thereto, the cap having an aperture therethrough, and sealingly inserting a tube through the aperture of the cap, the tube being connected to a source of pumpable cementitious material, said tube extending substantially to the bottom of said borehole and the source including a pumping device;

d. pumping an amount of the pumpable cementitious material through said tube into the space formed by the bottom of said borehole and said inside surface of said casing to a depth substantially sufficient to form an hydraulic seal at the lower end of the casing;

e. while the cementitious material is yet fluid, filling said casing with water from the topmost portion of said hydraulic seal to at least a level in the upper portion of said casing or adjacent to the upper end of said casing;

f. pumping said cementitious material from said pumping device through said tube into said water-containing casing to the lower end thereof in a sufficient amount and under sufficient pressure so as to fill the annular space formed between said casing and the walls of said borehole with said cementitious material;

g. allowing said cementitious material to cure to a hardened state to support said casing in a generally upright position;

h. inserting a substantially cylindrical metal pile form with a closed bottom end through, and driving the pile form beyond, the bore of said casing and in substantial axial alignment therewith, the pile form being driven to a depth in the subsoil sufficient to provide support for a structure at or above ground level, said pile form not extending into any aquifer and forming an annular space between the outer wall of said metal pile form and the inner wall of said casing;

i. filling said metal pile form with a pumpable structurally supporting cementitious material and allowing said structurally supporting cementitious material to cure, thus forming a structural support piling; and j. filling said annular space between the metal pile form and said casing with a pumpable cementitious material and allowing curing of said cementitious material to a hardened state.

2. The method of claim 1 plus the additional step of installing at least one anchor loop in the cementitious material at the top of said pile form.

3. The method of claim 1 wherein the zone of contamination is determined by analyzing soil samples obtained by core boring techniques.

4. The method of claim 1 wherein said metal pile form is a metal pipe.

5. The method of claim 4 wherein said metal pipe is a carbon steel pipe.

6. The method of claim 5 wherein cementitious material used in said step i is concrete.

7. The method of claim 6 wherein said concrete has a minimum breaking strength of about 1000 psi when cured.

8. The method of claim 7 wherein said cementitious material is grout.

9. The method of claim 8 wherein said grout is pressure grout.

10. Support apparatus for a structure to be supported at or above ground level on or over an earth formation having underground environmental contaminants in a zone at a predetermined depth, which apparatus comprises:

a. a metal casing having an upper end, a lower end, and inner and outer surfaces, the casing being of sufficient length to have its upper end at or above ground level and its lower end below the predetermined lowest level of contamination, and ending adjacent thereto, said casing having a substantially cylindrical wall, and being installed within subsoil in said ground in a generally upright position;

b. a substantially concentric layer of hardened cementitious material interposed between the casing and surrounding subsoil and in intimate contact therewith between the casing and the subsoil;

c. a metal pile form having an upper end and a lower end and an upper portion and a lower portion, said upper portion being substantially housed within the casing with an inner annular space therebetween, said pile form extending downwardly beyond said casing to an underground dense layer stratum without penetration of a dense layer stratum, said metal pile form having a closure at its lower end and said lower end extending insufficiently to penetrate any aquifer in the earth formation and having the upper end of said pile form extending to approximately the same level as the upper end of said casing;

d. a quantity of cured cementitious material substantially filling said annular space, and e. within the pile form a quantity of cured concrete material sufficient to substantially fill said metal pile form and thereby act as a support apparatus.

11. The apparatus of claim 10 wherein said metal pile form is a metal pipe.

12. The apparatus of claim 11 wherein said metal pipe is a carbon steel pipe.

13. The apparatus of claim 12 wherein said cured concrete material has a minimum breaking strength of about 1,000 psi.

14. The apparatus of claim 13 wherein said cementitious material is grout.

15. The apparatus of claim 14 wherein said grout is pressure grout.

16. The apparatus of claim 15 further comprising at least one anchor loop installed in the cementitious material at the top of the pile form and adapted to anchor said structure.

17. An array of support apparatuses supporting a structure at or above ground, each support apparatus being as defined in claim 10.

18. An array as in claim 17 comprising at least four support apparatuses.

19. An array as in claim 18 comprising at least 10 support apparatuses.

* * * * *